US006137460A

United States Patent [19]

Johnson et al.

[11] Patent Number: 6,137,460

[45] **Date of Patent: *Oct. 24, 2000**

[54] DISPLAY ELEMENT HAVING RETROREFLECTIVE SURFACE

[75] Inventors: Jerry L. Johnson, Veradale, Wash.; Kevin M. Hanson, Rathdrum, Id.; Kenneth R. Cummings, Mead; Edward A. Wilson, Spokane, both of Wash.

[73] Assignee: American Electronic Sign Company, Spokane, Wash.

[ * ] Notice: This patent is subject to a terminal disclaimer.

[21] Appl. No.: 09/087,765

[22] Filed: May 29, 1998

Related U.S. Application Data

[62] Division of application No. 08/566,909, Dec. 4, 1995, Pat. No. 5,790,088.

[51] Int. Cl.[7] ..... G09G 3/34

[52] U.S. Cl. ..... 345/84

[58] Field of Search ..... 345/84, 85, 86, 345/76, 77, 82, 44, 48, 111, 108; 40/582, 583, 443; 362/336, 338, 339, 340

[56] References Cited

U.S. PATENT DOCUMENTS 1,765,215 6/1930 Duchard .
2,798,147 7/1957 Orsatti .
3,267,595 8/1966 Levy et al. .
3,591,721 7/1971 Salam .
3,868,610 2/1975 Salam .
4,833,806 5/1989 Gars .
4,974,353 12/1990 Norfolk .
5,111,193 5/1992 Huber et al. .
5,231,689 7/1993 Reidinger .
5,351,065 9/1994 Killinger ..... 345/84
5,500,652 3/1996 Huber et al. .

*Primary Examiner*—Chanh Nguyen
*Attorney, Agent, or Firm*—Wells, St. John, Roberts, Gregory & Matkin, P.S.

[57] ABSTRACT

A pixel for use in a visual matrix display including a frame having front and rear surfaces and defining an aperture; a light source oriented in the aperture; a first retroreflective surface borne by the frame and positioned adjacent to the aperture; a flap borne by the front surface and moveable along a given path of travel between a first position wherein the pixel is nonoperational, and the flap is disposed in covering relation relative to the light source, and a second operational position, wherein the flap has a second retroreflective surface which is exposed when the flap is in the second position; an assembly borne by the frame for moving the flap along the given path of travel; and an assembly for energizing the light source when the flap is in one of the given positions along the path of travel.

2 Claims, 14 Drawing Sheets

DISPLAY ELEMENT HAVING RETROREFLECTIVE SURFACE

This application is a divisional of Ser. No. 08/566,909 filed Dec. 4, 1995, now U.S. Pat. No. 5,790,088.

TECHNICAL FIELD

The present invention relates to a pixel for use in a visual matrix display and more particularly, to improved pixels employing both translucent and opaque retroreflecting means. The pixels of the present invention find usefulness in all manner of informational display devices.

BACKGROUND OF THE INVENTION

Electronic display devices are commonly used today in many applications including portable highway safety signs, billboards, scoreboards and other informational displays. These display devices consist of multiple rows of individual display elements which constitute controllable pixels in a visual matrix display. Predetermined patterns of display elements can be programmed to create any desired message, design or image.

The prior art is replete with numerous disclosures of electronic display devices. For example, one such display element employed with such devices includes an opaque panel having an aperture provided therein, and an associated flap which is pivotable from a first position covering the aperture, to a second position uncovering the aperture. The side of the flap which faces an observer when the aperture is covered has a substantially nonreflective surface. The other side of the flap which faces the observer when the flap is uncovered has a highly reflective surface. Accordingly, when the flap is open, light is emitted. Further, ambient light is reflected from the of the flap towards the observer.

The electronic display element identified above typically has a translucent lens covering an associated aperture. Still further, U.S. Pat. No. 5,111,193 to Huber, et al., describes an electronic display element having a translucent lens in a panel aperture and a pivotable flap which covers and exposes the lens. The reference to Huber is incorporated by reference herein.

While the devices identified above have operated with varying degrees of success, there are shortcomings in each of the devices which have detracted from their usefulness under certain operational and environmental conditions. For example, under conditions of poor visibility, such as what might be experienced in heavy fog, rain, snow and the like, these same signs may not be as readily visibly discernable as under normal viewing conditions. It would be desirable, therefore, to provide an improved pixel for use in a visual matrix display and which has improved visibility under poor viewing conditions such as described above.

Still other shortcoming with the prior art devices have been a result of characteristics inherent in their overall design. For example, the prior art has disclosed the use of individual energizable lamps which are disposed in light emitting relation relative to the respective pixels. The individual lamps are energized and deenergized by a programmable controller. As would be expected, the maintenance of these individual lamps is often time consuming, and difficult in view of the remote locations where these devices are often employed. Still another shortcoming with the devices described in the prior art references relates to the operational modes of the pixels. For example, most of the prior art devices have only two specific modes of operation, that is, the pixel is either in an operational condition (on) or a nonoperational condition (off). It would be highly desirable therefore, to provide a pixel which has more than one mode of operation thereby providing increased design options for a programmer of such devices.

The present invention provides several forms of an improved pixel for a visual matrix display which effectively transmits light provided to the pixel from various light sources. The pixel of the present invention further reflects light originating from sources in front of the visual matrix display thereby providing a visual matrix display which remains visibly discernable notwithstanding the deenergized state of an associated light source.

BRIEF DESCRIPTION OF THE DRAWINGS

One or more preferred embodiments of the invention are described below with reference to the following accompanying drawings.

FIG. 6 is a third, fragmentary, side elevation view of a translucent lens employed with one form of the present invention.

FIG. 7 is a greatly enlarged, transverse, vertical sectional view taken from a position along line 7—7 of FIG. 6.

FIG. 14 is a greatly enlarged, vertical sectional view of one form of the pixel of the present invention.

FIG. 15 is a greatly enlarged, vertical sectional view of one form of the pixel of the present invention.

FIG. 17 is a greatly enlarged, transverse, vertical sectional view of one form of the pixel of the present invention.

FIGS. 18, A,B, and C, respectively, are greatly enlarged front elevation views of one form of the pixel of the present invention, shown in their individual modes of operation.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

U.S. Pat. No. 5,111,193 to Huber, et al. is hereby incorporated by reference into this disclosure.

Figure 1:
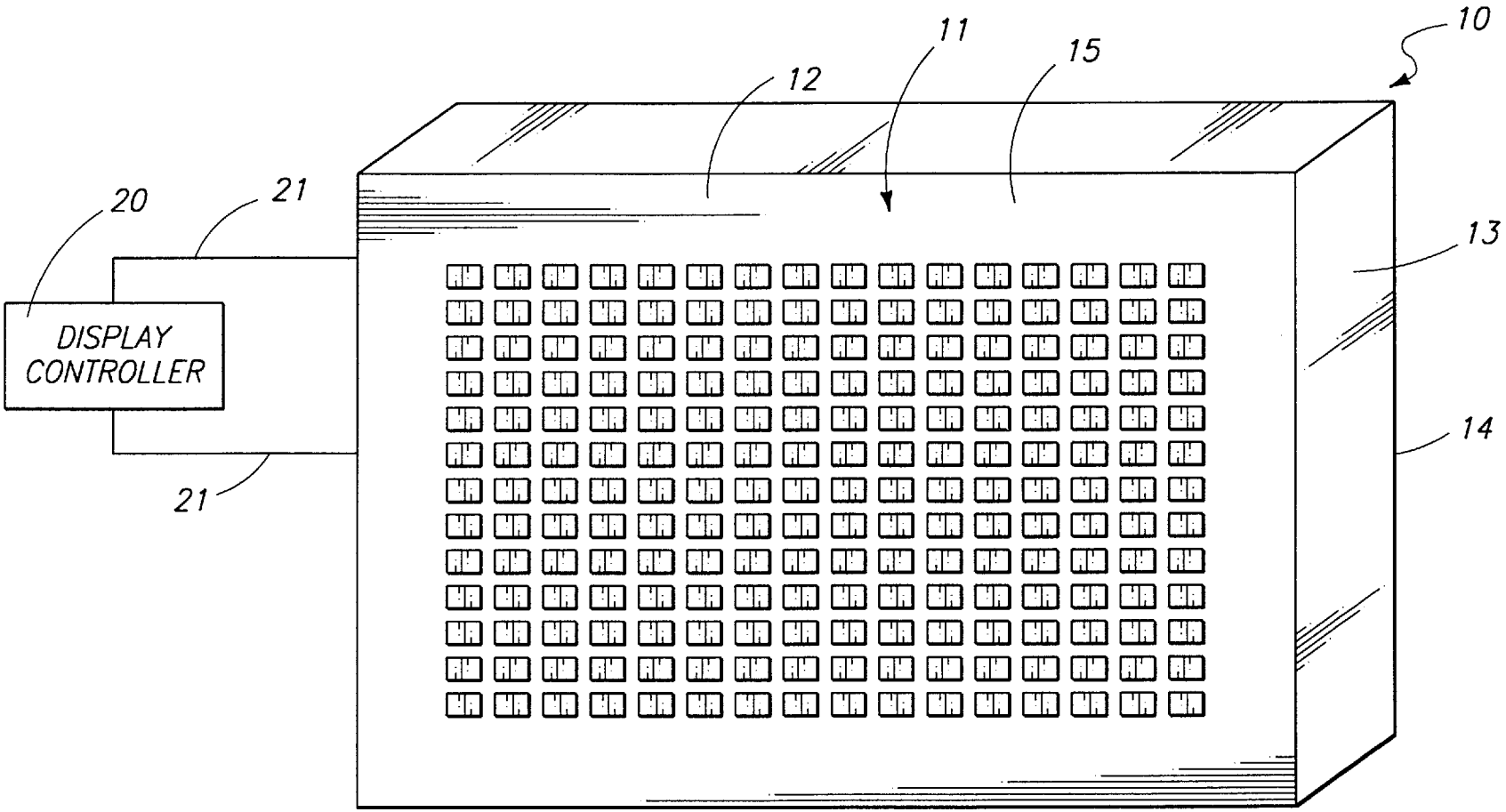
FIG. 1 is a perspective, environmental view of a visual matrix display which employs the various forms of the pixel of the present invention.

FIG. 1 shows a visual matrix display which employs the pixels of the present invention. The visual matrix display includes a housing 11 which has a front surface, or panel 12. Side walls 13 extend substantially normally rearwardly relative thereto. The housing has a back surface 14 which allows access to the interior cavity (not shown) of the housing 11. The front panel or surface 12 has an exterior facing surface 15, and an opposite interior facing surface 16. As seen in FIG. 1, the visual matrix display 10 has a display controller 16 which activates individual display elements or pixels to create the desired visual image. The individual pixels will be discussed in greater detail hereinafter. The display controller 20 is capable of receiving data indicative of a message or design and transforming that data into pixel data to selectively activate specific display elements which will hereinafter be described. The display elements provide the desired visual image. The display controller 20 is coupled to a busing system (illustrated graphically by the lines 20) which links the display controller 16 to each of the individual display elements of the visual matrix display 10. In the preferred embodiment, the display controller 20 is preferably a microprocessor, but can be any of several means for selectively actuating the display elements such as an application specific integrated circuit (ASIC) or a microcontroller. The display controller 20 may also include amplifiers, drivers and the like to insure that a sufficient electrical current is sent to the individual display elements to energize or deenergize same.

First Form

Figure 2:
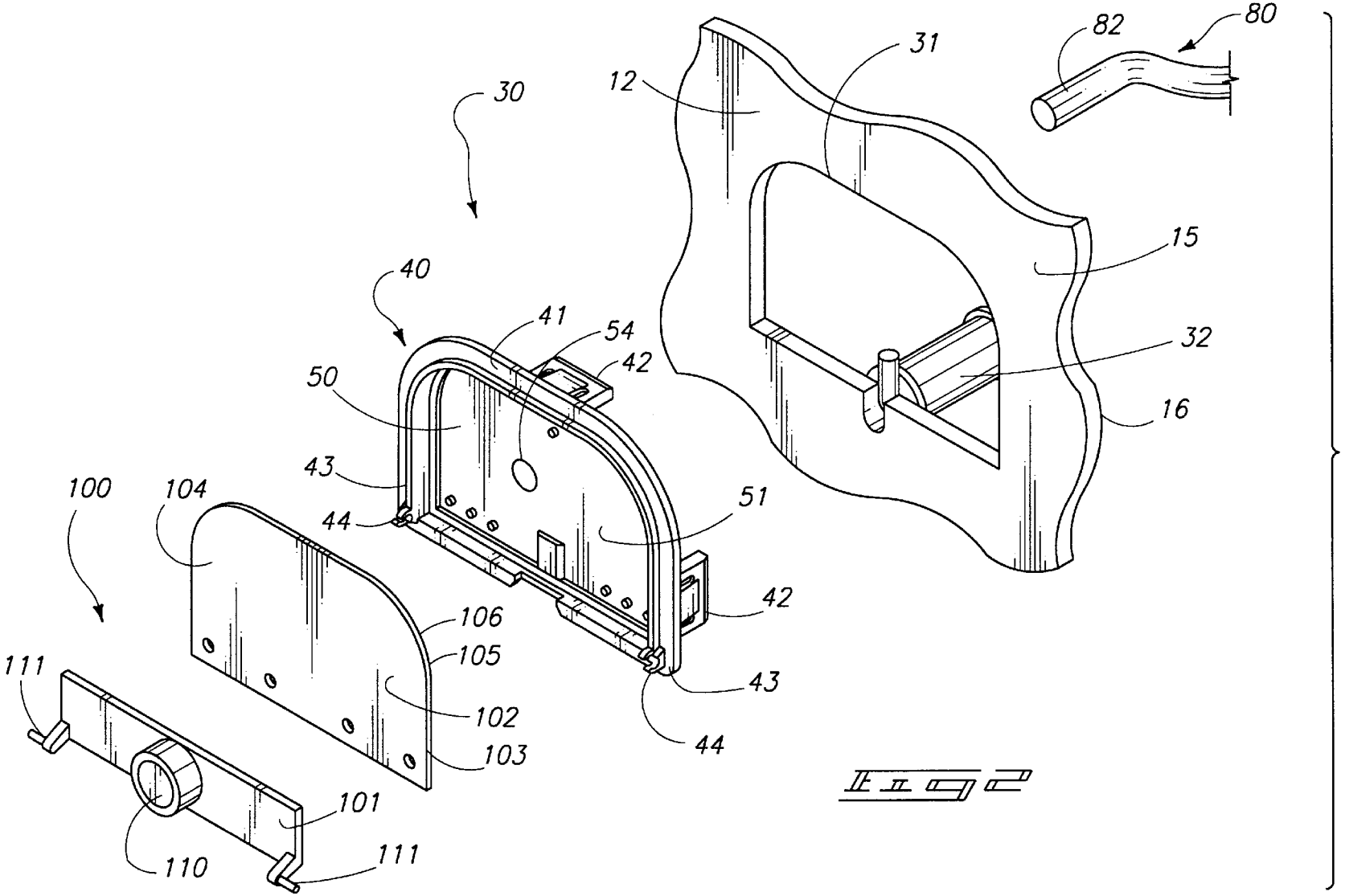
FIG. 2 is an enlarged, exploded, perspective view, of one form of the present invention.
Figure 4:
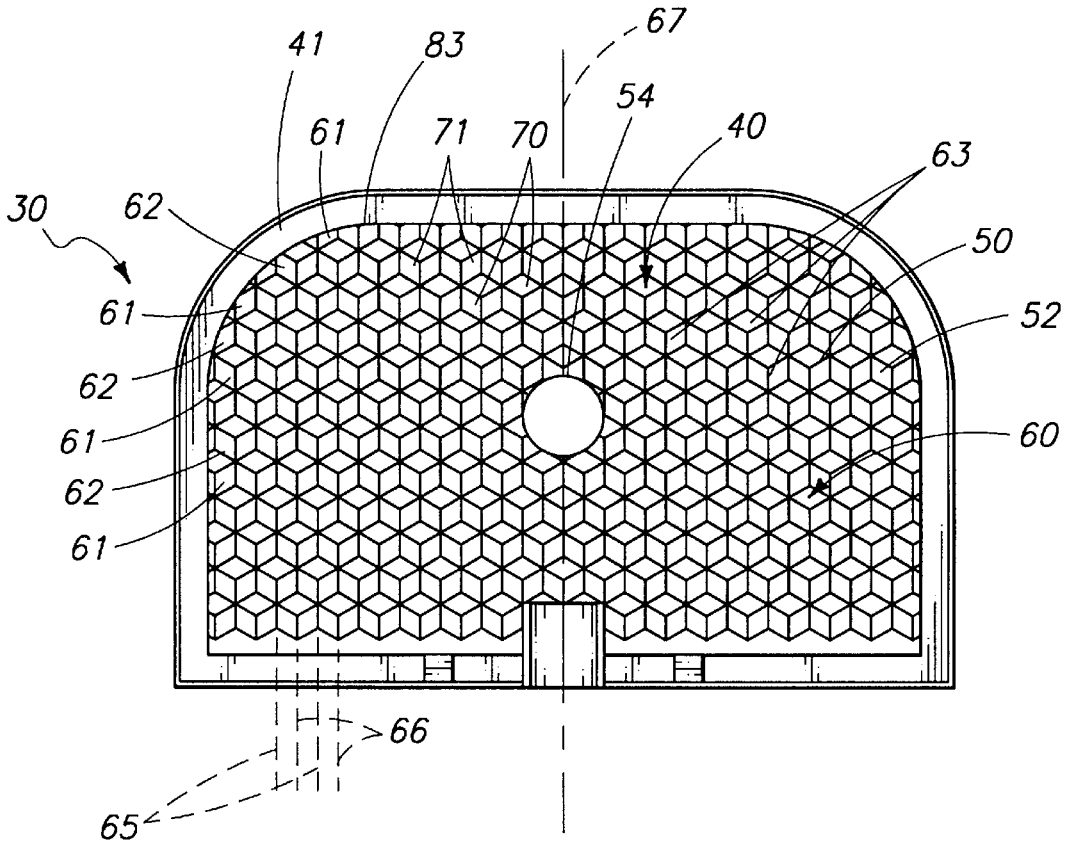
FIG. 4 is a fragmentary, front elevation view, of a translucent lens employed with one form of the present invention.
Figure 5:
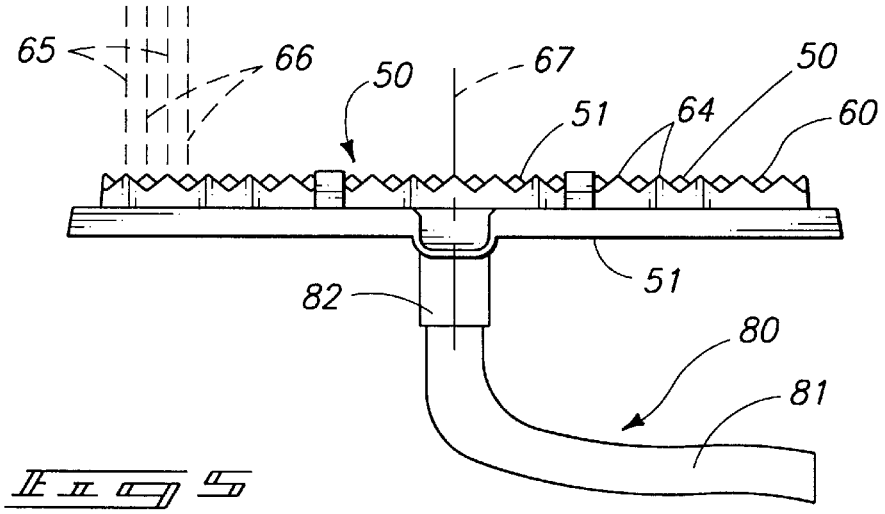
FIG. 5 is a second, fragmentary, side elevation view of a translucent lens and accompanying fiber optic cable employed with one form of the present invention.
Figure 13:
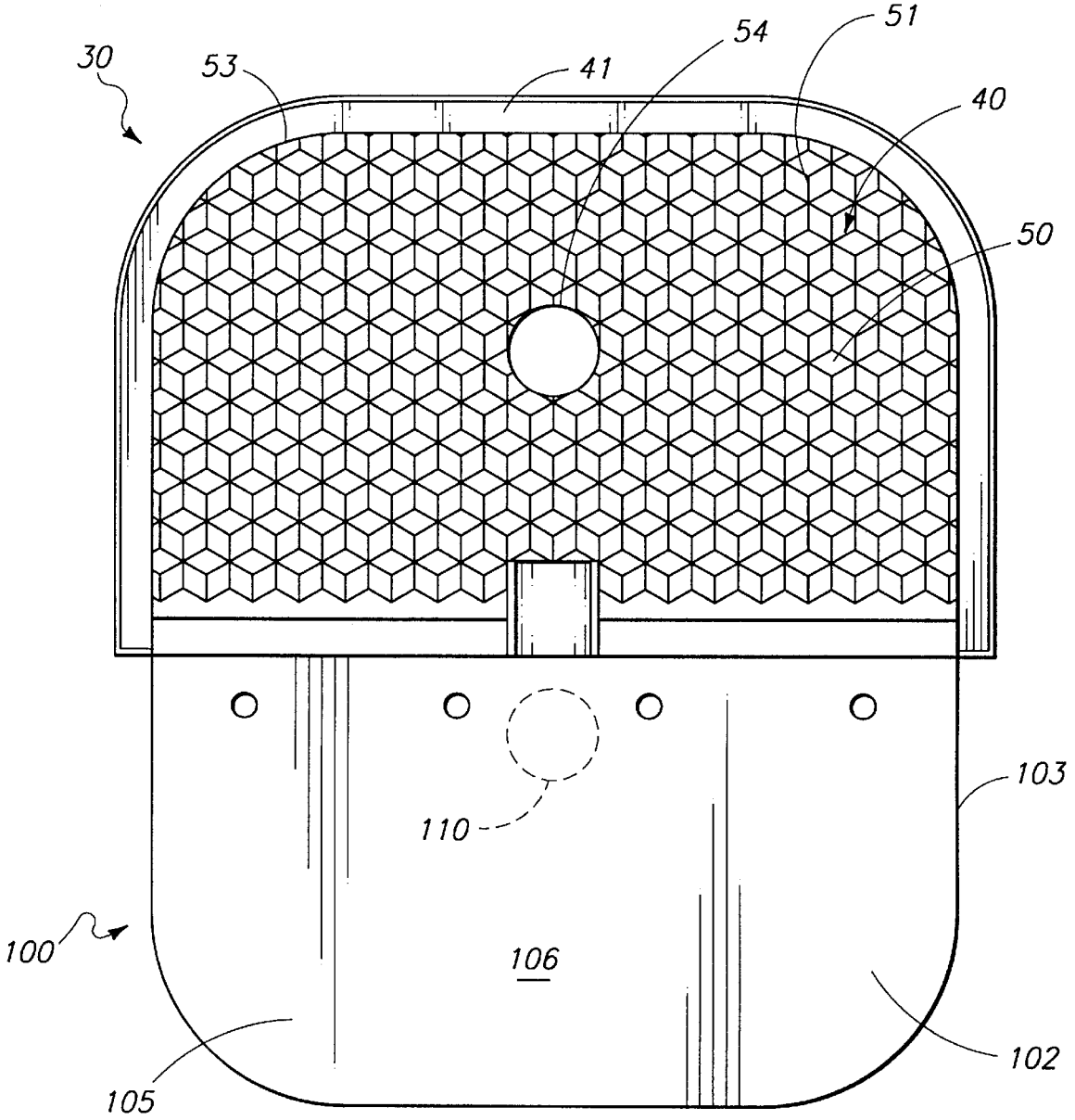
FIG. 13 is a greatly enlarged, front elevation view of one form of the pixel of the present invention.
Figure 11:
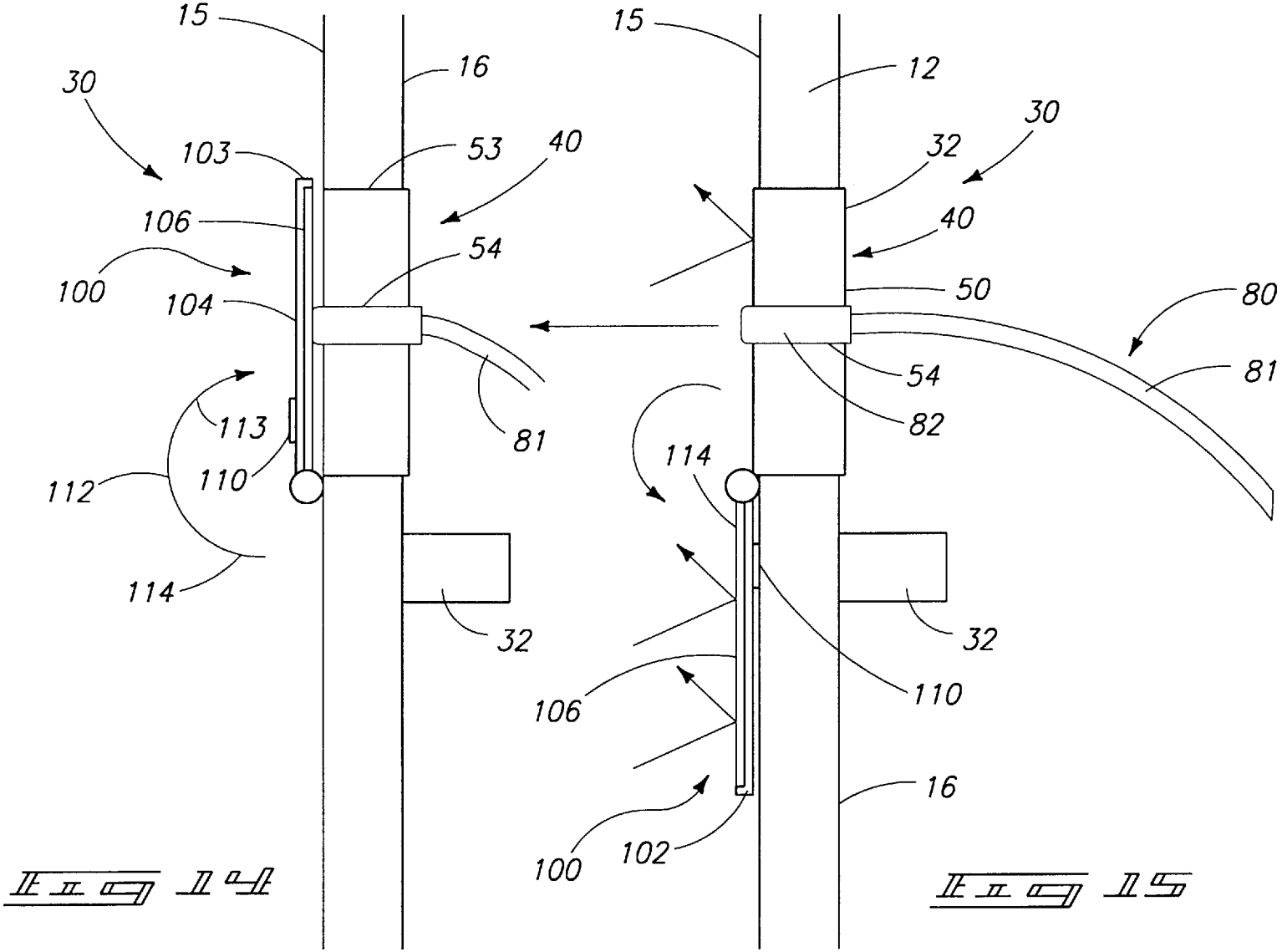

The first form of the invention is generally indicated by the numeral 30 in FIG. 2 and 13, respectively. As shown in FIG. 2, a plurality of apertures 31 are formed in the front panel or surface 12. As illustrated in FIG. 1, the apertures are formed in predetermined rows, and columns. As seen most clearly by reference to FIG. 2, an electromagnet of conventional design 32 is mounted on the interior facing surface 16 of the front panel 12. The operation of the electromagnet is discussed in detail in the reference to Huber and therefore for purposes of brevity is not discussed in further detail herein. A display element which is generally indicated by the numeral 40 is matingly received in the individual apertures 31. The display element 40 of the first form of the invention has a peripheral frame 41 which includes individual fastening clips 42 which releasably engage the front panel or surface 12 in the manner of a snap-fit. The peripheral frame 41 also includes opposing exterior facing corners 43. Individual axle bearings 44 are affixed to each of the opposing corners. As illustrated most clearly by reference to FIG. 13, a substantially uniformly retroreflective and translucent lens 50 is fastened or otherwise secured internally of the peripheral frame 41. The translucent lens 30 is formed of colored plastic which is preferably red or orange, although other colors can also be employed. The retroreflective lens 50 includes a forwardly facing lens surface 51, and opposite, rearwardly facing surface 52. The translucent lens is further defined by a peripheral edge 53. As best seen in FIGS. 4 and 5, a light aperture 54 of predetermined dimensions is formed substantially centrally thereof.

As seen most clearly be reference to FIGS. 6 and 7, a cube prism pattern, which is generally indicated by the numeral 60 is made integral with the rear surface 52. As best seen in FIG. 4, the cube prism pattern has alternating first horizontal rows 61 and second horizontal rows 62 respectively. All of the horizontal rows have multiple uniformly shaped cubes generally indicated by the numeral 63. As will be recognized, only three faces of the cubes 63 are exposed. The cubes 63 are oriented in such a fashion that one corner (represented by the numeral 64) of each of the cube projects outwardly from the planar boundary. The first and second horizontal rows 61 and 62 are slightly offset or staggered from each other. Further, the multiple, uniformly shaped cubes 63 in the first row are aligned relative to their corners 64 along first vertical axes 65. Similarly, the cubes in the second row 62 are aligned relative to their corners 64 along second vertical axes 66. The first rows 61 are also centered on a central axis 67 (which coincides as one of the first vertical axes 65) while the second rows 62 are arranged symmetrically such that the second vertical axes are parallel to, offset from and centered between adjacent first vertical axes 60.

Figure 3:
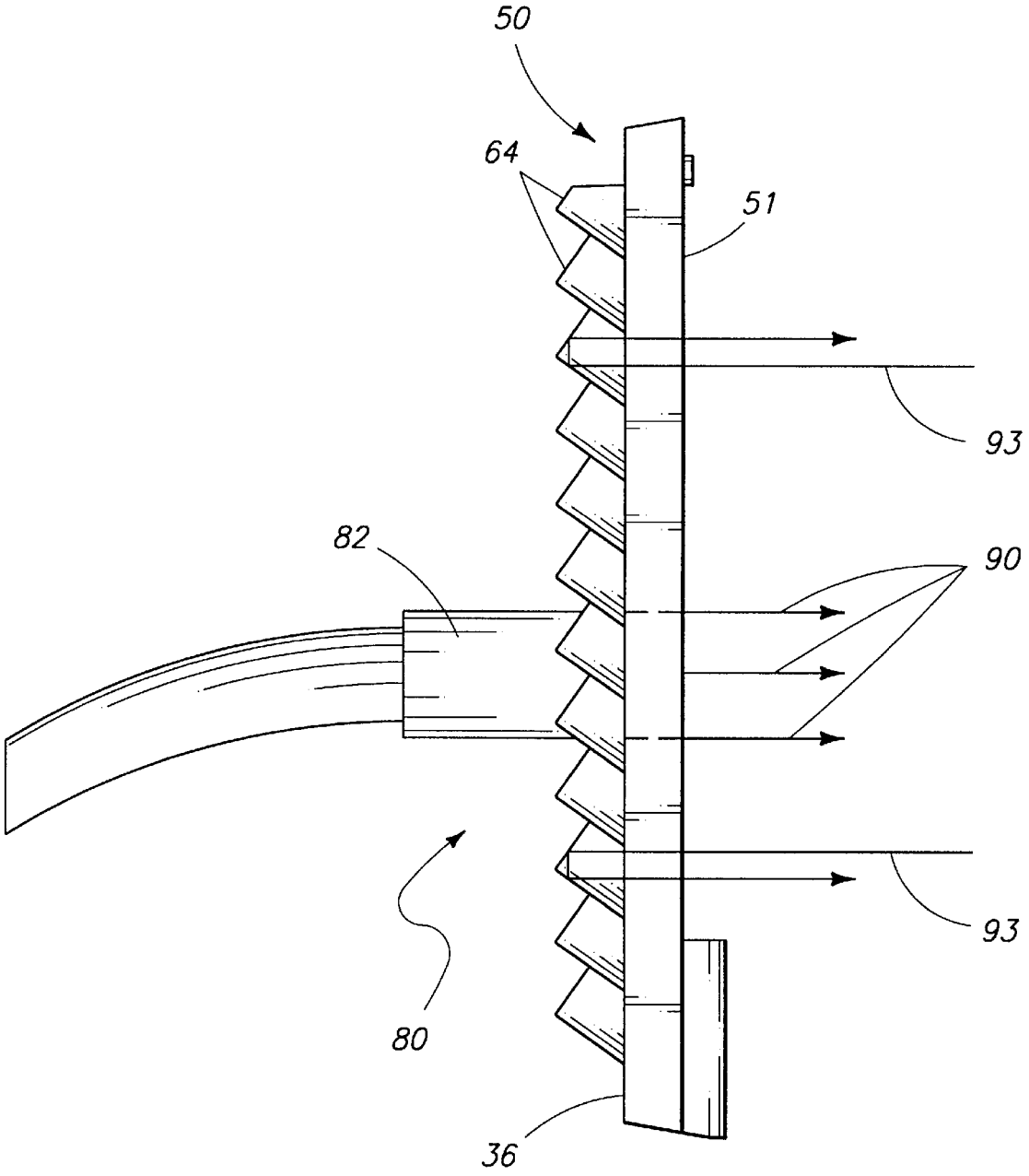
FIG. 3 is a fragmentary, side elevation view, of a translucent lens and accompanying fiber optic cable employed with one form of the present invention.

As an alternative way to describe the cube prism pattern 60, the rear surface 52, of the lens 50, has a multiplicity of uniformly shaped polyhedron cells 70 which have hexagonal bases (when viewed from the rear surface as shown in FIG. 3) and parallelogram faces 71. Preferably, the polyhedron cells 70 have 3 parallelogram faces which are most preferably square.

FIGS. 6 and 7 illustrate the orientation of the uniformly shaped cubes 63 in more detail. As illustrated, the cubes 63 are tilted or angled at angle A to provide the more appropriate orientation to project corners 64 away from the planar boundary 65. Preferably, angle A is approximately 35 degrees. In FIG. 7, which is taken through lines 7—7 of FIG. 6, and parallel to the face of the cube rows, the internal dimensions of each cube 63 are identical and symmetrical. Angle B, which is measured between adjacent faces of adjacent cubes, is preferably 90 degrees. Likewise, angle C, which is measured between adjacent faces of the same cube 63, is preferably 90 degrees. The cubes 63 are oriented in such a manner that angle D is preferably 45 degrees.

This perfectly symmetrical, cube pattern on the rear surface 52 permits light which originates from behind the translucent lens 50 to pass therethrough without significant interference while optimally retroreflecting light which originates from remote locations in front of the retroreflective lens 50. Accordingly, the lens of this invention is significantly brighter than nonretroreflective lenses of conventional design.

Figure 8B:
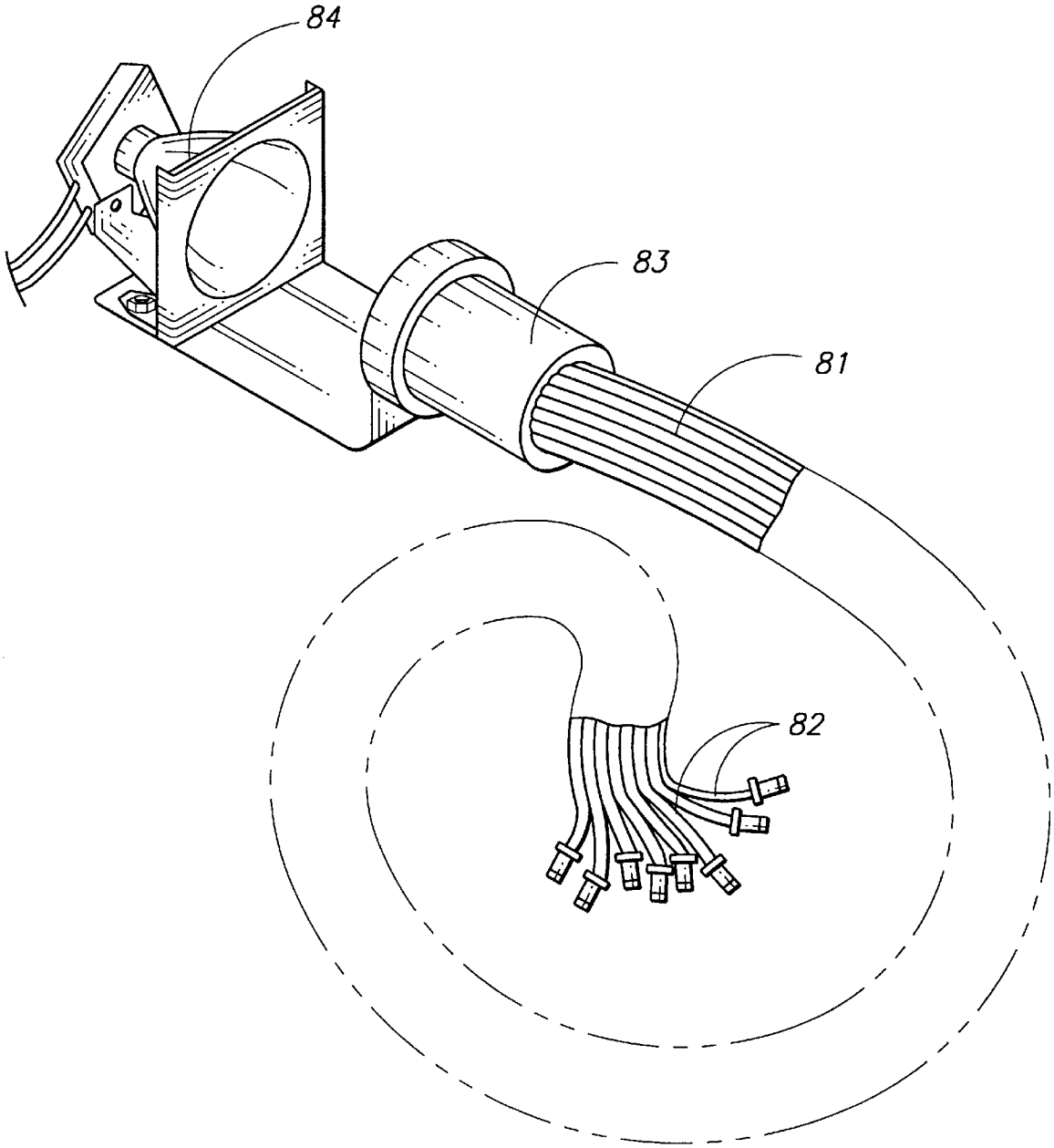
FIG. 8 is a fragmentary, perspective view of one form of lighting and fiber optic cable assembly employed with the present invention.
Figure 9:
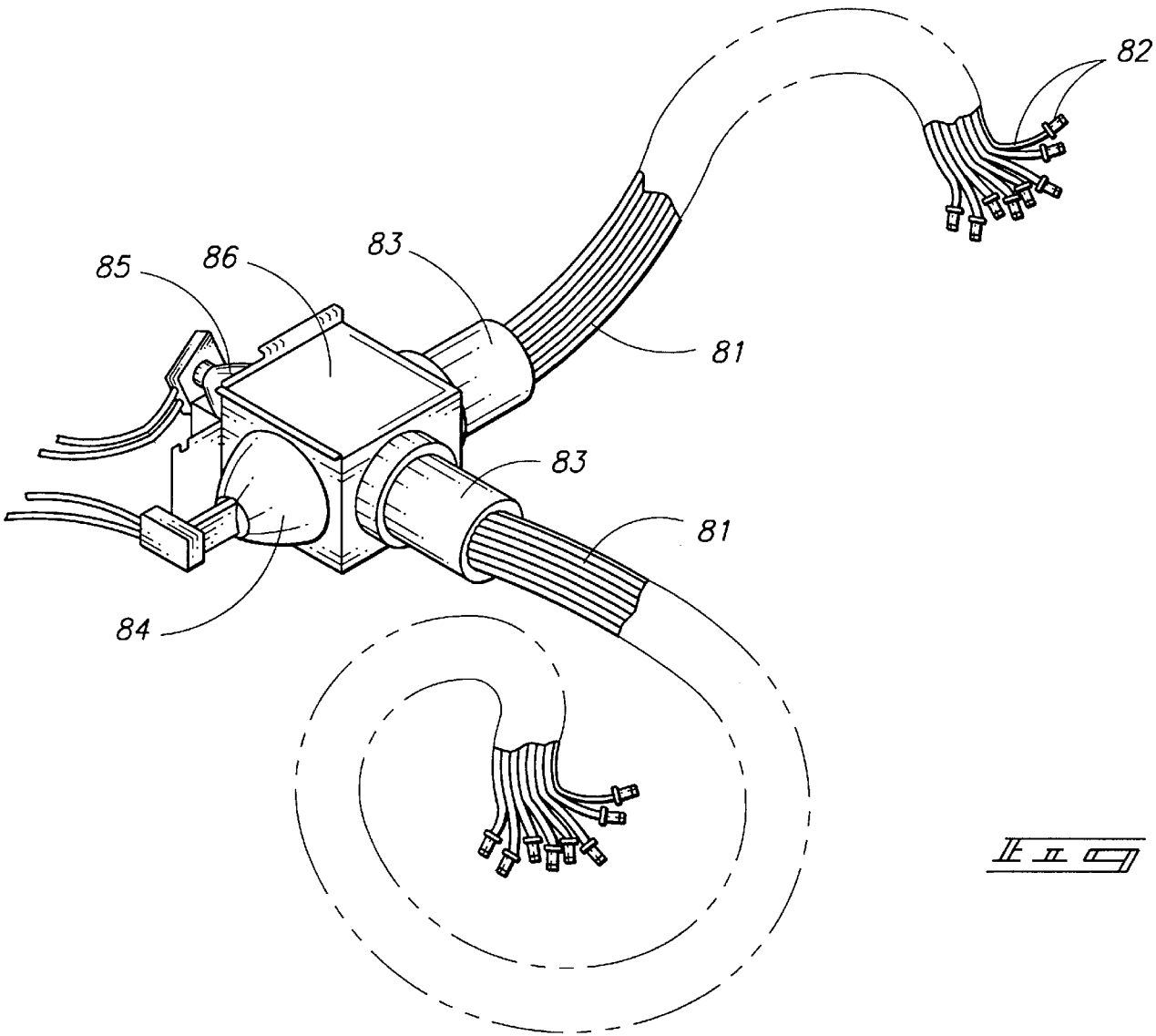
FIG. 9 is a fragmentary, perspective view of an alternate form of a lighting and fiber optic cable assembly employed with the present invention.
Figure 10:
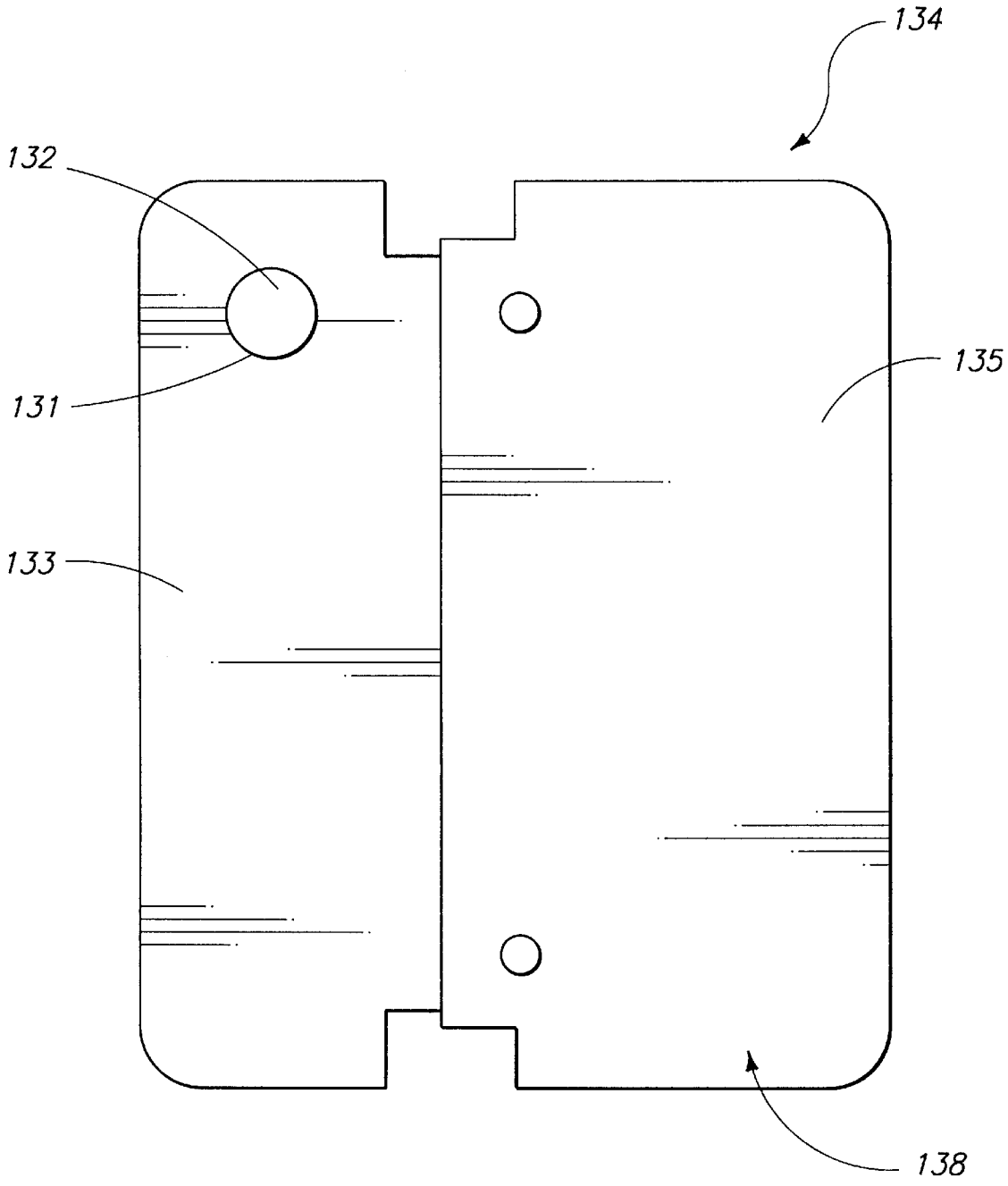
Figure 11:
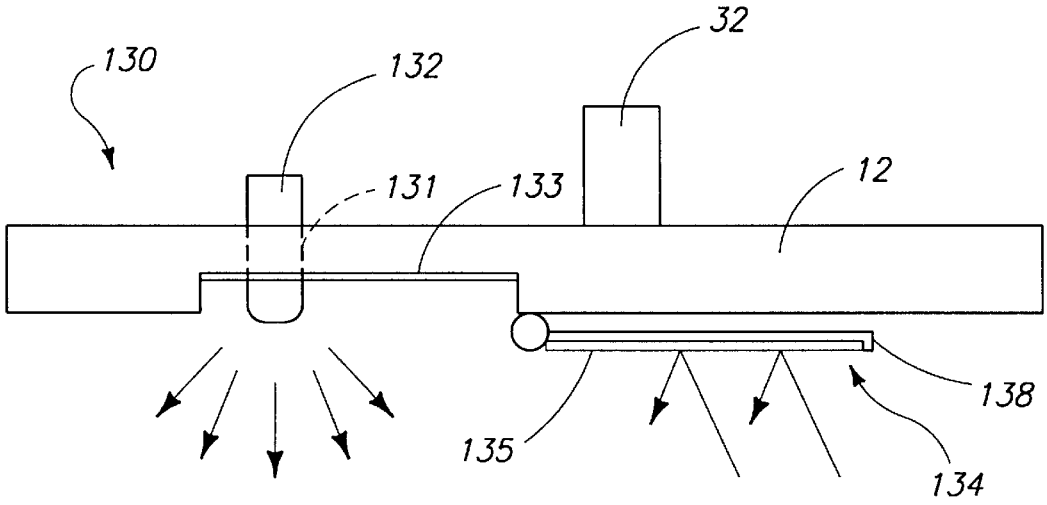

The first form of the invention 30 includes a light source which is generally indicated by the numeral 80. In the first form of the invention, the light source 80 comprises a fiber optic cable 81. The fiber optic cable has a first, light discharging or emitting end 82 which is matingly received and otherwise secured in the light aperture 54. Further, the fiber optic cable has a second, light intake or receiving end 83. As best shown in FIGS. 8 and 9, an electrically energizable lamp 84, or in the alternative, 85, are mounted in light emitting relation relative to the fiber optic cable 81. In the first form, a single lamp 84 (FIG. 8) is mounted in light emitting relation relative to the second or light receiving end 83 of the fiber optic cable 81. In the second form (FIG. 9), a pair of lamps 85 are mounted in light emitting relation relative to the second or light intake end 83. In each instance, housing 86 fixes the lamp in a given orientation relative to the light receiving end 83 of the fiber optic cable 81. As should be understood, when a pair of lamps are employed (FIG. 9), the housing 86 encloses a beam splitting subassembly which allows the lamps to be alternatively energized in the event of a single lamp failure.

As shown most clearly by reference to FIG. 3, rays of light 90 which are emitted by the fiber optic cable 81 escape the fiber optic cable at the light discharging end 82, and are oriented in a direction forwardly of the display element 40 such that the light may be viewed remotely by an observer. As will be recognized, the extreme distal portion of the discharge end of the fiber optic cable is positioned just slightly forward and out of the plane of the forwardly facing surface 51 of the retroreflective lens. Therefore, when the retroreflective lens 50 is viewed from an observer's position forwardly of the retroreflective lens 50, the retroreflective lens appears substantially uniformly illuminated and further includes a brightly lit substantially centrally disposed area which represents the discharge end 82 of the fiber optic cable 81. This relatively bright light has the overall effect of drawing the attention of an observer in the direction of the visual matrix display 10 under poor visibility conditions. Still further, under reduced ambient lighting conditions, a visual matrix display 10 employing the present form of the invention will normally remain visibly discernable under poor visibility conditions in view of the concentrated nature of the light transmitted from the individual fiber optic cables 80. As will be recognized from a study of FIG. 3, the retroreflective lens is operable to reflect light originating from locations forward of the display element 40 back along substantially parallel courses in the direction of the remote light source or the observer. Therefore, in those instances where the light source 80 is deenergized, as by failure of the power source or some other malfunction, the visual matrix display 10 will remain visibly discernable notwithstanding the deenergized state of the light source 80.

The first form of the invention 30 includes a flap which is generally indicated by the numeral 100. The flap 100 is pivotally mounted on the frame 41 to selectively cover or expose the retroreflective lens 50. The flap 100 comprises a support member 101 and an associated opaque member 102. The opaque member 102 is defined by a peripheral edge 103 that is substantially complementary in size, and shape to that of the retroreflective lens 50. The flap 100 further has a forwardly facing surface 104, which is coated with a surface which reduces reflection to a minimum, and has an opposite, rearwardly facing surface 105 which has a retroreflective, opaque surface affixed thereto.

As will be recognized, the flap 100 also includes a magnet 110 which is fixed on the support member 101, and which works in combination with the electromagnet 32 which is secured on the interior facing surface 16 of the front panel 12. The electromagnet 32 selectively cooperates with the magnet 110 to cause the flap 100 to selectively cover, or be displaced from, the retroreflective lens 50. The construction of the electromagnet and the operation of the flap 100 caused by the interaction between the electromagnet and magnet are described in detail in U.S. Pat. No. 5,111,193 to Huber, et al., the teachings of which are incorporated by reference herein.

As best seen by reference to FIG. 2, the flap 100 includes a pair of axle pins 111 which are substantially coaxial aligned one with the other, and which are operable to matingly cooperate with the individual axle bearings 44 which are borne by the peripheral frame 41. In this manner, the flap 100 is rendered operable for rotational movement about a pivot axis to selectively cover, or alternatively expose the retroreflective lens 50. As will be recognized, the pins and bearings constitute a preferred embodiment for facilitating the pivotal movement of the flap 100. Additionally, the axle pins and bearings could be reversed such that the pins are mounted in alternative locations such as on the peripheral frame 41 and on the support member 101.

As will be seen by a study of FIGS. 14 and 15, respectively, the flap 100 is moveable along a given path of travel 112 between a first or occluding position 113 (FIG. 14) wherein the translucent lens 50 is covered, and cannot be observed, and a second or displaced position 114 (FIG. 15) whereby the retroreflective surface 106 can be observed. As will be seen in FIG. 13, the flap 100, when located in the second position 114 forms an operational pixel, and any light generated by the light source 80 may escape from the discharge end 82 of the fiber optic cable 81 and may be viewed remotely by an observer from a position which is forward of the display element 40. As will be recognized by a study of FIG. 13, the flap 100, and the retroreflective lens 50 each have a given surface area which is about one-half the surface area of the operational pixel.

Second Form

Figure 11:
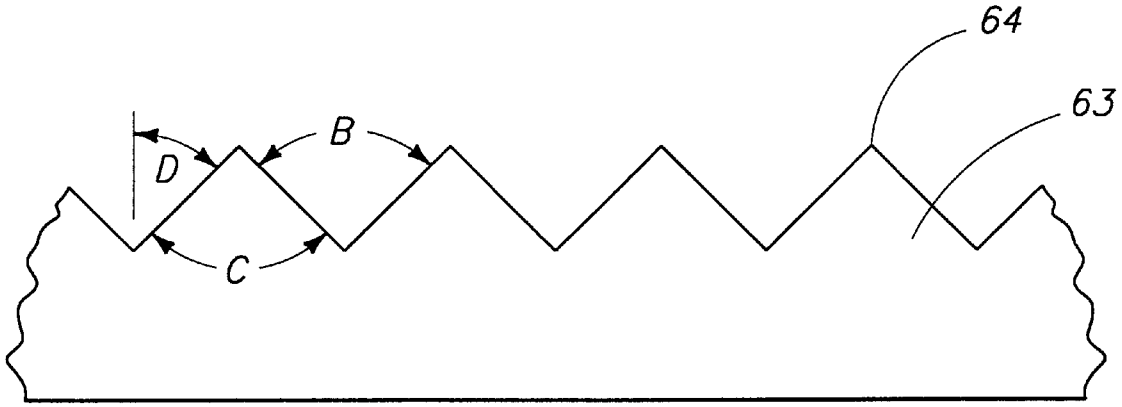
FIG. 11 is a greatly enlarged, side elevation view of one form of the pixel of the present invention.
Figure 10:
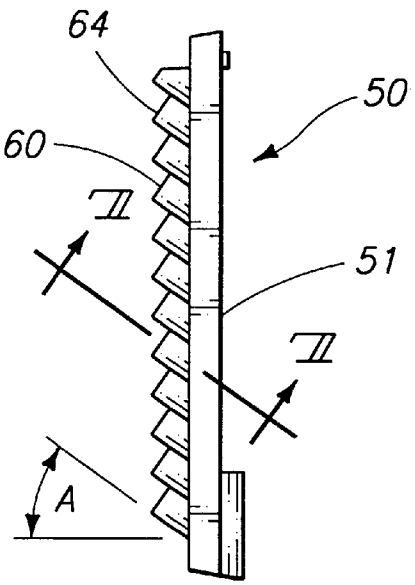
FIG. 10 is a greatly enlarged, front elevation view of one form of the pixel of the present invention.
Figure 12:
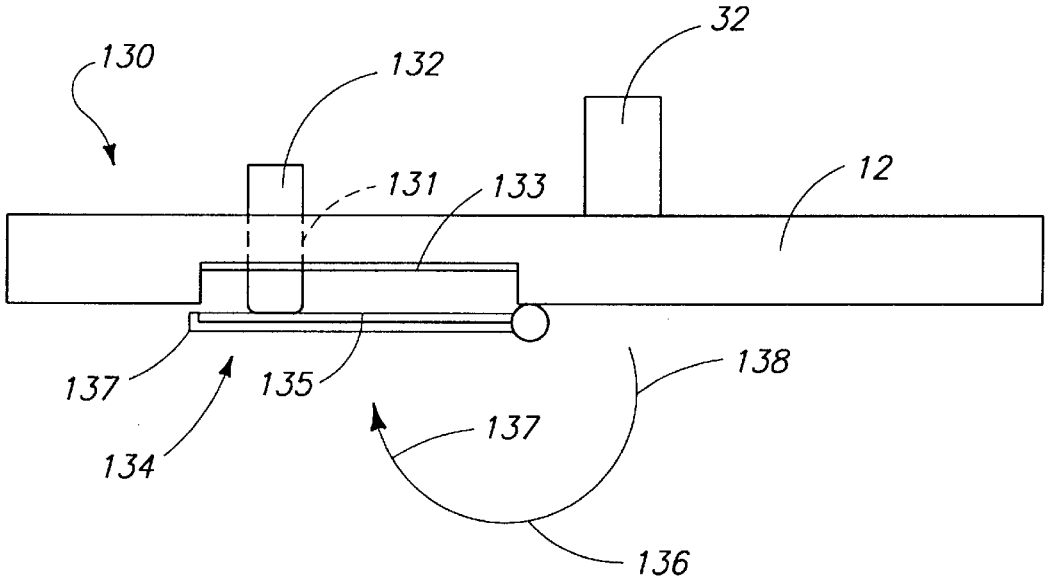
FIG. 12 is a greatly enlarged, side elevation view of one form of the pixel of the prevent invention.

The second form of the invention is generally indicated by the numeral 130 in FIG. 10. As shown in FIGS. 11, and 12, the second form of the invention 130 includes an aperture 131 which is formed in the front panel 12 and which matingly receives a light source, such as a light emitting diode (LED) 132. A first retroreflective surface 133 is borne by the front panel 12 and is positioned adjacent to or in surrounding manner relative to the aperture. The first retroreflective surface 133, which is opaque, will reflect some light emitted from the light emitting diode 132. Therefore, from a remote observer's viewpoint, and when the LED 132 is energized, the first retroreflective surface appears substantially uniformly back lighted when in fact, the light emitted from the LED is escaping the housing 11 without passing through any accompanying translucent lens. Therefore, the apparent luminous area of LED is greatly enhanced without employing light sources which would consume ever increasing levels of electrical power and increased space. A rotatable flap 134 is provided. The flap 134 is of similar construction to that earlier disclosed with respect to the first form of the invention 30. Therefore, for purposes of brevity, the rotatable flap 134 is not discussed in further detail herein. As was the case with the flap 100, which was disclosed in the first form of the invention 30, a second retroreflective surface 135 is fixed on the flap 134, and provides approximately one-half of the surface area of the operational pixel. As seen in FIGS. 11 and 12, the flap 134 is moveable along a path of travel 136 between a first position 137 wherein the pixel is nonoperational, and the flap 134 is disposed in covering relation relative to the first retroreflective surface 133, and the accompanying light source 132; and a second uncovered or displaced position 138 wherein the first and second retroreflective surfaces 133 and 135 can be readily discerned by a remote observer who is located in a position forward of the respective retroreflective surfaces 133, and 135.

As with the first form of the invention 30, the second form of the invention 130 provides an operational pixel which will reflect artificial or ambient light which originates from remote locations, and thus, will continue to be visibly discernable by a remotely positioned observer notwithstanding that the LED 132 is deenergized.

The light emitting diodes 132 utilized in the second form of the invention 130 provide certain unique advantages from the standpoint of energy consumption and the ability to utilize a visual matrix display in environments where reliable sources of electricity may be difficult to access. For example, in view of the relatively low power consumption of light emitting diodes 132, the present visual matrix display 10 may be outfitted with a rechargeable battery pack, and an accompanying solar panel which will recharge the battery pack thereby providing a convenient means to provide a visibly discernable visual matrix display in remote locations where electricity is not normally available. Still further, it will be recognized that the earlier disclosed light source employed the first form of the invention and which includes a fiber optic cable, and accompanying lamps may be substituted in place of the LED with equal success. Still further, the use of LEDs 132 provides advantages from the standpoint of allowing the visual matrix displays 10 to be manufactured which have a thinner profile than what has been possible heretofore.

Third Form

Figure 16:
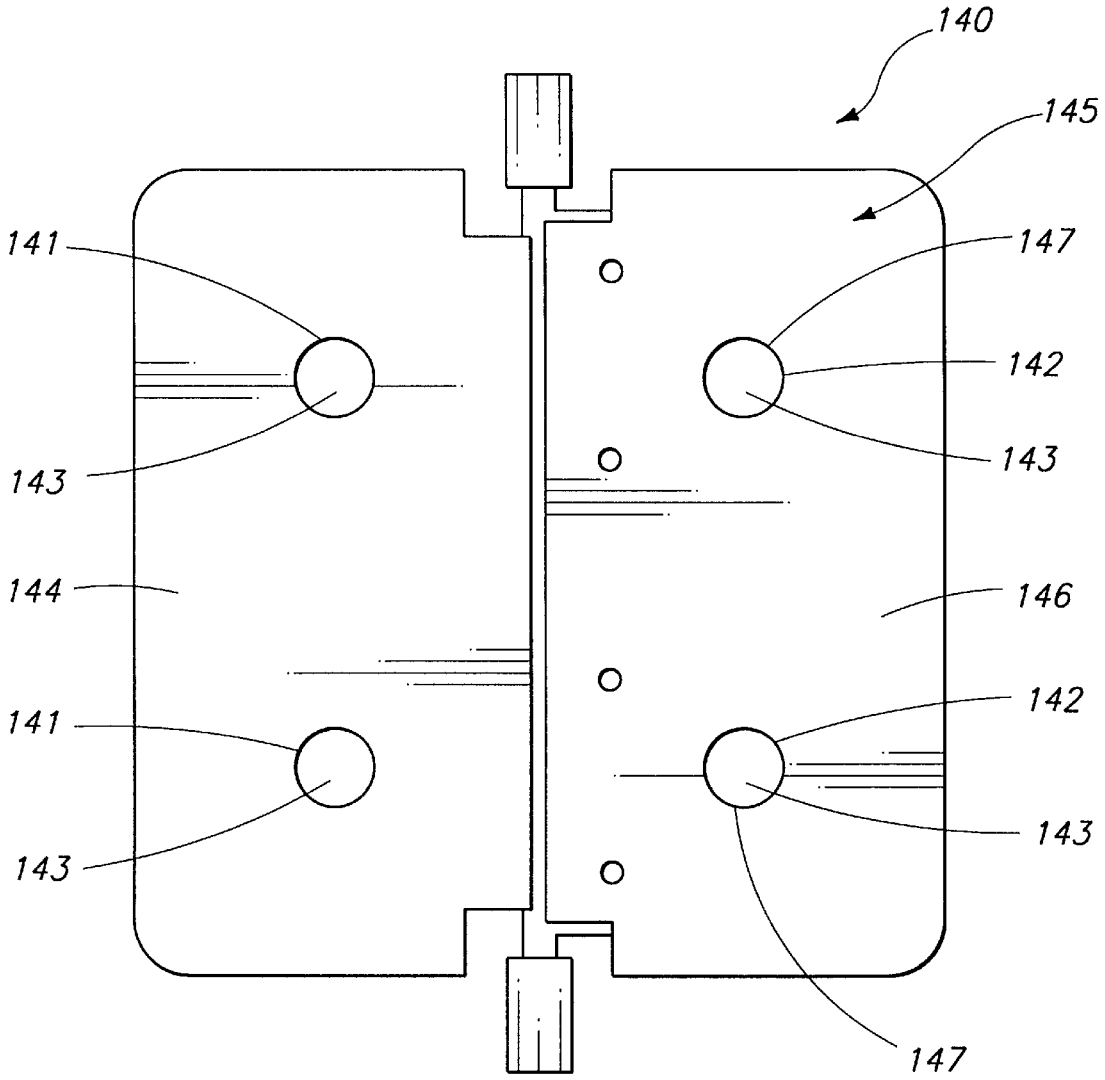
FIG. 16 is a greatly enlarged, front elevation view of one form of the pixel of the present invention.
Figure 11:
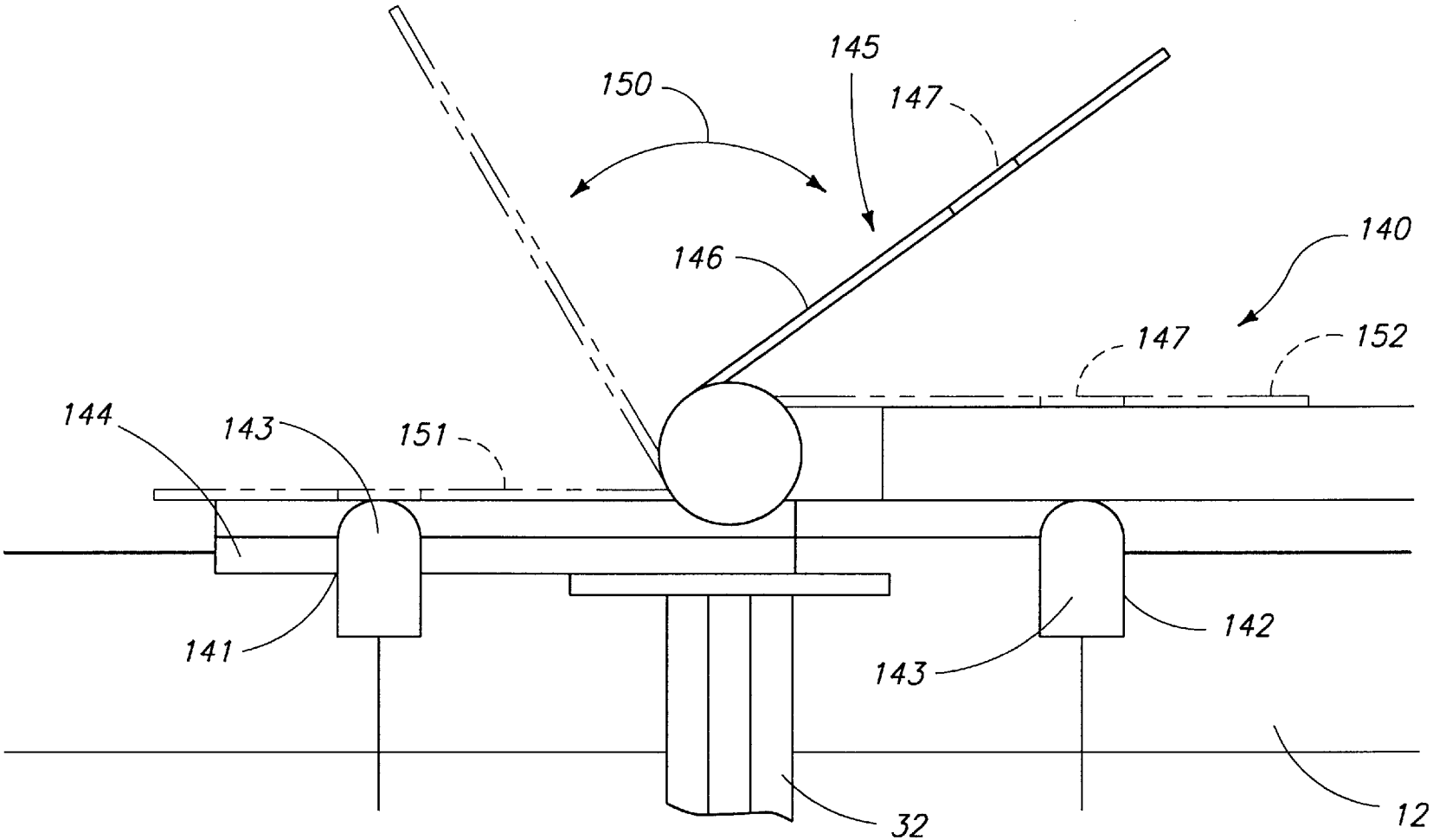
Figures 11A, 11B, 11C:
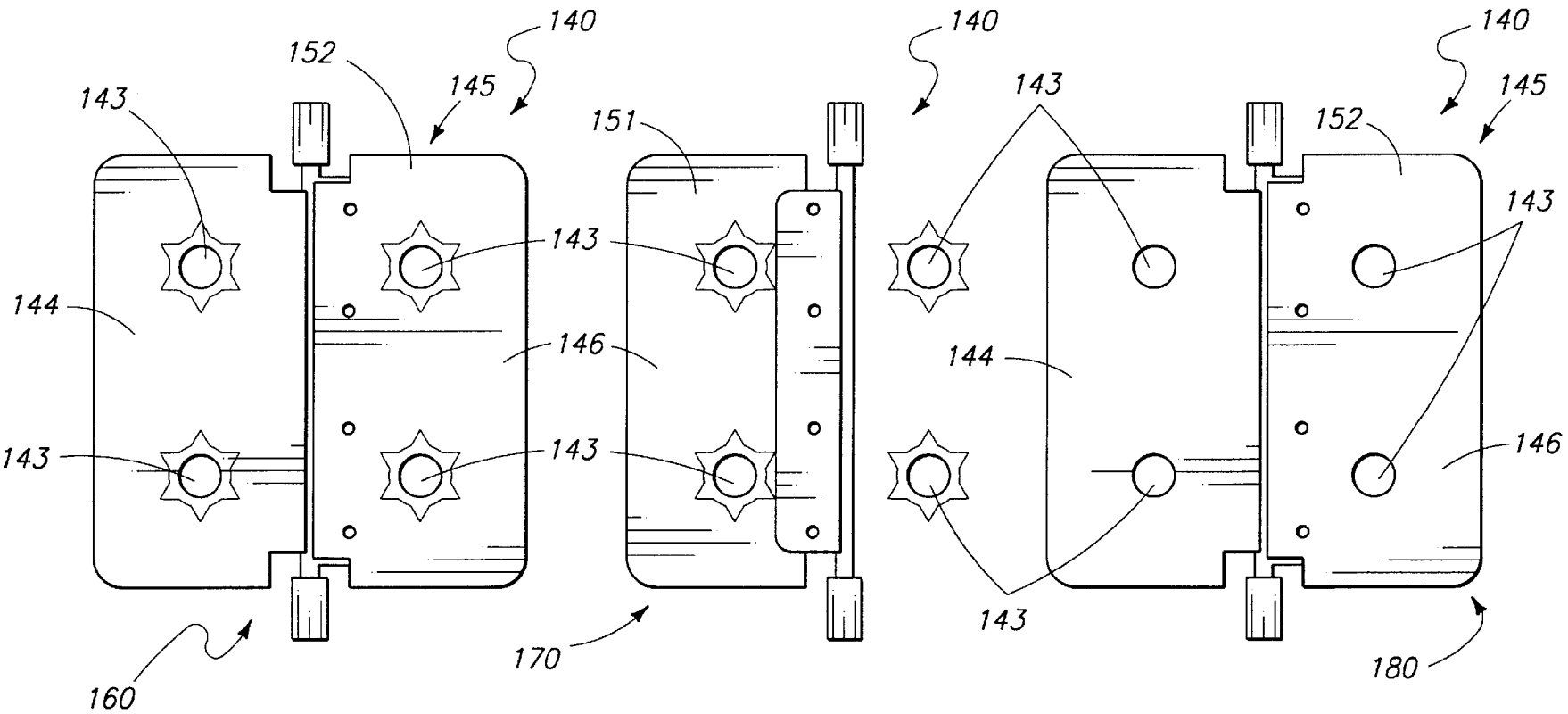

The third form of the invention is generally indicated by the numeral 140 in FIG. 16. As shown therein, the third form of the invention is very similar to the second form of the invention 130, but has some notable differences. More particularly, the third form of the invention includes two pairs of apertures, a first pair 141, and a second pair 142 respectively. The individual pairs of apertures are located in predetermined spaced relation one to the other. Each of the apertures matingly receives individual light emitting diodes (LEDs) 143. Further, as shown in FIG. 16, a first retroreflective surface 144 is positioned adjacent to the first pair of apertures 141. The third form of the invention 140 also includes a rotatable flap 145 which is similar in construction to the first form of the invention 30. A second retroreflective surface 146 is affixed on the rotatable flap 145. As will be seen in FIGS. 16 and 17, a third pair of apertures 147 are formed in predetermined locations in the rotatable flap. The rotatable flap 145 is moveable along a given path of travel 150 between a first position 151, wherein the flap is disposed in covering relation relative to the first retroreflective surface 144; and a second position 152, where it is displaced therefrom. As will be recognized, the second pair of apertures 147 are formed in a predetermined position in the rotatable flap such that when the rotatable flap 145 is oriented in the first position 151, the third pair of apertures 147 are substantially coaxially aligned with the first pair of apertures 141. Further, when the rotatable flap 145 is located in the second position 152, the third pair of apertures are substantially coaxially aligned relative to the second pair of apertures 142. As will be recognized, in either the first or second positions, the individual light emitting diodes 143 remain exposed. Light may escape, therefore, from the light emitting diodes and be seen by a remotely positioned observer when the LEDs are energized.

The third form of the invention provides three distinctive modes of operation. In this regard, the first mode of operation 160 is shown in FIG. 18A. In this first mode of operation, the rotatable flap 145 is located in the second position 152, whereby it forms an operational pixel. Further, the individual LEDs 143 which are oriented in light emitting relation relative to the first and second pairs of apertures 141 and 142, respectively are energized. In the second mode of operation which is generally indicated by the numeral 170 in FIG. 18B, the rotatable flap 145 is located in the first position 151, that is, in substantially covering relation relative to the first retroreflective surface 144; and the individual LEDs 143 are energized. Finally, in the third mode of operation 180 which is shown in FIG. 18C, the rotatable flap 145 is located in the second position 152, and the individual LEDs, 143 are deenergized.

As will be recognized, the third form of the invention 140 provides increased design capability for operators of such visual matrix displays 10.

Operation

The operation of the described forms of the present invention are believed to be readily apparent and are briefly summarized at this point.

A pixel for use in a visual matrix display 10 is best seen by reference to FIGS. 10, 13, and 16, respectively. As shown therein, the pixel for use in a visual matrix display 10 includes a frame 12 having front and rear surfaces 15 and 16, respectively, and defining an aperture 31, 54, 131, 141, and 142; a light source 80, 132, and 143, oriented in the aperture; a first retroreflective surface 50, 133, and 144, borne by the frame and positioned adjacent to the aperture; a flap 100, 134 and 145 borne by the front surface and moveable along a given path of travel 112, 136, and 150, between a first position 113, 137, and 151, wherein the pixel is nonoperational, and the flap is disposed in covering relation to the light source, and the first retroreflective surface, to a second operational position 114, 138, and 152, and wherein the flap has a second retroreflective surface 106, 135, and 146, which is exposed when the flap is in the second operational position; means borne by the frame 32 for selectively moving the flap along the given path of travel; and means for energizing the light source 20 when the flap is in one of the given positions along the path of travel.

More specifically, another aspect of the present invention relates to a first form of the invention which includes a pixel for use in a visual matrix display 10 including, a frame 12 having front and rear surfaces 15 and 16, and defining an aperture 31; a translucent, substantially planer retroreflective lens 50 borne by the frame and oriented in substantially occluding relation relative to the aperture, the translucent retroreflective lens further defining a substantially centrally disposed light emitting aperture 54; a fiber optic cable received in the light emitting aperture, the fiber optic cable having a light receiving end 83, and an opposite light discharging end 82; a source of light 84 and 85, positioned in light emitting relation relative to the light receiving end of the fiber optic cable; a flap 100 borne by the front surface of the frame and moveable along a given path of travel 112 between a first position 113, wherein the flap occludes the aperture and is in covering relation relative to the light discharging end of the fiber optic cable, to a second position 114, wherein the flap is oriented in a nonoccluding position relative to the light discharging end of the fiber optic cable, and wherein the flap 100 has a retroreflective surface 106 which is exposed when the flap is oriented in the second position, and wherein the retroreflective surface of the flap and the translucent lens form an operational pixel; means borne by the frame for moving the flap along the given path of travel 32 between the first and second positions; and means for selectively energizing the light source when the flap is in the second position 20 the light produced by the light source emitted from the light discharging end of the fiber optic cable.

Still another aspect of the present invention includes a pixel for use in a visual matrix display 10 which includes a frame 12 having front and rear surfaces 15 and 16, and defining an aperture 131; a light source 132 mounted in the aperture; a first, opaque retroreflective surface 133 borne by the frame and oriented in an adjacent location relative to the light source; a flap 134 pivotally borne by the frame and moveable along a given path of travel 136 from a first position 137, wherein the flap is disposed and substantially covering relation relative to the first retroreflective surface, and the light source, and a second position 138, wherein the flap is oriented in a displaced position relative to the first retroreflective surface and the light source, and wherein the flap has a second retroreflective surface 135 which is exposed when the flap is oriented in the second position, the first and second retroreflective surfaces forming an operational pixel when the flap is in the second position; means borne by the frame for moving the flap 32 along the given path of travel; and means borne by the frame for energizing the light source 20 when the flap is in the second position.

Still a further aspect of the present invention includes a pixel for use in a visual matrix display 10 comprising a frame 12 defining first and second apertures 141 and 142, respectively, a light source 143 mounted in each of the first and second apertures; a first, opaque retroreflective surface 144 borne by the frame and positioned adjacent the first aperture; a pivotally moveable flap 145 borne by the frame and moveable along a given course of travel 150, the flap having a second retroreflective surface 146, and further defining a third aperture 147, which is positioned in a predetermined orientation, and wherein the flap is moveable from a first position 151, wherein the flap is oriented in substantially covering relation relative to the first retroreflective surface, and the third aperture is substantially coaxially aligned relative to the first aperture, and a second position 152, wherein the flap is displaced relative to the first aperture, and wherein the flap in the second position exposes the second retroreflective surface and the third aperture is oriented in substantially coaxial alignment relative to the second aperture;. means borne by the frame for moving the flap along the given path of travel 32 from the first to the second position; and means coupled with each of the light sources for selectively energizing the respective light sources 20 when the flap is in the first and second positions.

As will be seen the first 30, second 130, and third 140 forms of the invention provide a convenient means whereby a visual matrix display 10 can be employed in remote locations to provide all manner of predetermined visual indicia which may be viewed remotely by an observer under diminished lighting conditions or under environmental conditions which detract from the visibility of same.

In compliance with the statute, the invention has been described in language more or less specific as to structural and methodical features. It is to be understood, however, that the invention is not limited to the specific details described, since the means herein disclosed comprise preferred forms of putting the invention into effect. The invention is, therefore, claimed in any of its forms or modifications within the proper scope of the appended claims appropriately interpreted in accordance with the Doctrine of Equivalents.

What is claimed is:

1. A pixel for use in a visual matrix display, comprising:

a frame having front and rear surfaces, and defining an aperture;

a first opaque retroreflective surface borne by the front surface and surrounding the aperture, the retroreflective surface defining a forward plane;

an electromagnet mounted on the rear surface of the frame and which when energized produces a magnetic force;

a light source having a light discharge end received in the aperture, the light discharge end located forward of the forward plane defined by the retroreflective surface, and wherein the light source when energized appears, from a normal viewing distance, to substantially uniformly illuminate the retroreflective surface such that it appears that it is uniformly backlit and further provides a substantially brightly illuminated portion adjacent the uniformly illuminated retroreflective surface;

a flap pivotally mounted on the front surface of the frame and adjacent the aperture, and which further is moveable along a given path of travel between a first position wherein the pixel is nonoperational, and the flap is disposed in covering relation relative to the light source, and the first retroreflective surface, to a second operational position, and wherein the flap has a second retroreflective surface which is exposed when the flap is oriented in the second position, and wherein a magnet is mounted on the flap and is influenced by the electromagnet when the electromagnet is energized, the magnet causing the flap to move along the path of travel under the influence of the magnetic force generated by the electromagnet; and means for selectively energizing the light source and the electromagnet to energize the light source and locate the flap in one of the positions along the path of travel.

2. A pixel for use in a visual matrix display, comprising:

a frame having front and rear surfaces, and defining first and second apertures, the front surface defining a forward plane;

a first opaque retroreflective surface borne by the front surface and surrounding the first aperture;

an electromagnet mounted on the rear surface of the frame and which when energized produces a magnetic force;

a first and second light source each having a light discharge end individually received in the respective first and second apertures, each of the light discharge ends being located forward of the forward plane defined by the front surface of the frame, and wherein the first light source when energized appears, from a normal viewing distance, to substantially uniformly illuminate the first retroreflective surface such that it appears that it is uniformly backlit and further provides a substantially brightly illuminated portion adjacent the uniformly illuminated retroreflective surface;

a flap pivotally mounted on the front surface of the frame and adjacent the first opaque retroreflective surface, and wherein the flap has a third aperture formed therein, and wherein the flap is moveable along a given path of travel between a first position wherein the flap is disposed in substantial covering relation relative to the first retroreflective surface, and the third aperture is substantially coaxially aligned with the first light source, to a second position, and wherein the flap has a second retroreflective surface which is exposed when the flap is oriented in the second position and the third aperture is substantially coaxially aligned with the second light source, and wherein the first and second light sources, when energized appear, from a normal viewing distance, to substantially uniformly illuminate the first and second retroreflective surfaces such that it appears that each is uniformly backlit and further provides a substantially bright illuminated portion adjacent the substantially uniformly illuminated first and second retroreflective surfaces, and wherein a magnet is mounted on the electromagnet is energized, the magnet causing the flap to move along the path of travel under the influence of the magnetic force generated by the electromagnet; and means for selectively energizing the first and second light sources and the electromagnet to provide illumination and locate the flap in one of the positions along the path of travel.

* * * * *